United States Patent [19]

Matsuda et al.

[11] 4,416,967

[45] Nov. 22, 1983

[54] DIAZO COPYING ELEMENT

[75] Inventors: Tsutomu Matsuda, Tokyo; Takeo Hirabayashi, Numazu; Takeshi Yanagihara; Shinjiro Sakurai, both of Yokohama, all of Japan

[73] Assignee: Ricoh Co., Ltd., Tokyo, Japan

[21] Appl. No.: 372,362

[22] Filed: Apr. 27, 1982

[30] Foreign Application Priority Data

Apr. 30, 1981 [JP] Japan ..... 56-66591

[51] Int. Cl.[3] ..... G03C 1/52

[52] U.S. Cl. ..... 430/159; 430/160; 430/176

[58] Field of Search ..... 430/159, 160, 176

[56] References Cited

U.S. PATENT DOCUMENTS

| | | | |
|---|---|---|---|
| 2,980,534 | 4/1961 | Printy et al. | 430/289 |
| 3,159,487 | 12/1964 | Krieger et al. | 430/159 |
| 3,380,824 | 4/1968 | Bach | 430/159 |
| 3,520,242 | 7/1970 | Kemp et al. | 430/160 |
| 3,733,200 | 5/1973 | Takaishi et al. | 430/160 |
| 3,904,414 | 9/1975 | Welch | 430/159 |
| 4,123,276 | 10/1978 | Kita et al. | 430/176 |
| 4,128,426 | 12/1978 | Ohta et al. | 430/159 |

FOREIGN PATENT DOCUMENTS

| | | | |
|---|---|---|---|
| 53-138327 | 12/1978 | Japan | 430/159 |

*Primary Examiner*—Charles L. Bowers, Jr.

*Attorney, Agent, or Firm*—Flynn, Thiel, Boutell & Tanis

[57] ABSTRACT

A one-component or binary type diazo copying element comprises a substrate, a pre-coat layer overlying the substrate, said pre-coat layer being consisted essentially of fine particle silica and a specific copolymer having a glass transition temperature in the range of −20° C. to 50° C., and a diazo photosensitive layer overlying the pre-coat layer.

8 Claims, No Drawings

DIAZO COPYING ELEMENT

BACKGROUND OF THE INVENTION (1) Field of the Invention

The present invention relates to a diazo copying element. In particular, it relates to a one-component or binary type diazo copying element wherein a novel binder (binder resin) is used in a pre-coat layer overlying a substrate.

(2) Description of the Prior Art

The now generally utilized diazo copying elements comprise an original paper for use in diazo copying (high quality paper, medium quality paper or the like), a pre-coat layer overlying the surface of said original paper, and a diazo photosensitive layer overlying said pre-coat layer, wherein the diazo photosensitive layer constituting the one-component type diazo copying element contains a diazo compound (diazonium salt) but does not contain a coupling component, while the diazo photosensitive layer containing the binary type diazo copying element contains both a diazo compound and a coupling component. And, these diazo copying elements mostly include a back-coat layer formed on the back of the original paper (substrate).

The reason for forming a pre-coat layer in this instance is to aim at preventing a diazo photosensitive layer-forming liquid from permeating into the original paper as well as aim at smoothing the surface of the original paper for uniform coating of said forming liquid, increasing the image density and saturation, improving the image sharpness and the like.

The material (binder) for use in the above mentioned pre-coat layer normally includes vinyl acetate resin, vinyl acetate-styrene copolymer resin, acrylamide resin and the like.

However, the conventional diazo copying elements are defective in that since these resins used in the pre-coat layer act to promote the oxidation decomposition of azo dye (image area formed by coupling reaction between the diazo compound and coupler) caused by light and air, when the resulting copy is exposed to light and air its image area fades markedly with the results that the image density deteriorates, the image color tone changes and thus the copy becomes indistinct.

SUMMARY OF THE INVENTION

The present invention provides diazo copying elements (one-component type and binary type diazo copying elements) which are capable of eliminating shortcomings as mentioned above and maintaining the resulting high quality image for a long period of time.

In other words, the present invention provides diazo copying elements comprising a substrate, a pre-coat layer overlying said substrate, and a diazo photosensitive layer overlying said pre-coat layer, characterized in that the pre-coat layer consists essentially of fine silica particles and a copolymer obtained by emulsion polymerization of essential components (a) 5–40% by weight of at least one member of hydroxyalkylacrylate and hydroxyalkylmethacrylate and (b) 5–60% by weight of at least one member of styrene and acrylonitrile and having a glass transition temperature in the range of −20° C. to 50° C.

DETAILED DESCRIPTION OF THE PREFERRED EMBODIMENTS

The present invention will be explained in more detail hereinafter.

As the substrate used in the present invention there can be enumerated plastic film, synthetic paper, cloth and the like in addition to paper. And, on this substrate, as previously stated, there is superimposed the pre-coat layer consisted essentially of fine silica particles as the filler and the specific copolymer as the binder.

The fine particle silica is effective for intensifying an apparent image density, and is preferable to have a particle diameter of about 0.1–10$\mu$ and a mean particle diameter of about 1$\mu$.

The above mentioned specific copolymer, as stated previously, is one prepared by emulsion polymerization of essential components (a) at least one member of hydroxyalkylacrylate and hydroxyalkylmethacrylate and (b) at least one member of styrene and acrylonitrile and having a glass transition temperature in the range of −20° C. to 50° C. Referring to the percentages of said copolymer's components to the total monomers to be emulsion polymerized, the component (a) is 5–40% by weight, preferably 10–30% by weight and the component (b) is 5–60% by weight, preferably 20–50% by weight.

This copolymer is prepared by the normal emulsion polymerization, but attention should be paid hereat to the fact that when the percentage of the component (a) constituting the monomer composition is less than 5% by weight there can not be attained the effect of improving the fading in the image area as intended by the present invention, while when said percentage is in excess of 40% by weight the polymerization stability of the emulsion is apt to be lost and the water resisting strength of the photosensitive paper becomes too insufficient to be put to practical use.

On the other hand, when the percentage of the component (b) constituting the monomer composition is less than 5% by weight there can not be attained the intended effect of improving the fading in the image area, while when said percentage is in excess of 60% by weight the resulting copolymer is so hard that the adhesion thereof to fine particle silica becomes insufficient and said silica particles can not disperse uniformly and further the silica comes to lose the faculty as the adhesive to form the pre-coat layer for the base paper (substrate), whereby there is caused a tendency to hamper the production of a high quality photosensitive paper intended for practical use.

When styrene and acrylonitrile are used concurrently as the component (b), the percentages of both of these can be selected optionally. And, when components more than two members selected from the group consisting of hydroxyalkylacrylate and hydroxyalkylmethacrylate are used concurrently, the percentages of these monomers can also be selected optionally.

As the concrete instances of the component (a), namely hydroxyalkylacrylate and hydroxyalkylmethacrylate there can be exemplarily enumerated hydroxyethyl(meth)acrylate and hydroxypropyl(meth) acrylate, but additionally enumerated hydroxymethyl(meth)acrylate, hydroxybutyl(meth)acrylate, hydroxyoctyl(meth)acrylate, hydroxyhexyl(meth)acrylate, hydroxydodecyl(meth)acrylate, hydroxyallyl(meth)acrylate, hydroxyphenyl(meth)acrylate, hydroxybenzyl(meth)a-crylate and the like. However, it is to be noted that the component (a) should not be limited to them alone.

As the material for the above mentioned copolymer there can be employed copolymerizable monomers in addition to the above components (a) and (b), so far as said monomers do not hinder the object of the present invention. The exemplary examples of such monomers include methyl(meth)acrylate, ethyl(meth)acrylate, propyl(meth)acrylate, n-butyl(meth)acrylate, i-butyl(meth)acrylate, 2-ethylhexyl(meth)acrylate and the like. In addition thereto, there can be employed normal radical polymerizable monomers such as α-methylstyrene, vinyltoluene, methacrylonitrile, vinyl acetate, acrylic acid, methacrylic acid, itaconic acid, maleic acid, glycidyl(meth)acrylate, (meth)acrylamide, N-methylol(meth)acrylamide and the like.

Further, the copolymer used in this pre-coat layer is required to have a glass transition temperature in the range of −20° C. to −50° C., preferably 10° C. to 35° C. When the glass transition temperature of the copolymer is lower than −20° C., it is inferior in fading property and so is not qualified for the diazo photosensitive material, while when said transition temperature is higher than 50° C. the copolymer is not suitable for practical use because the adhesive property of fine particle silica can not be displayed to the full.

Some preparation examples of this copolymer using the conventional emulsion polymerization method will be enumerated hereinafter.

(1) 44 parts by weight of acrylonitrile, 20 parts by weight of n-butyl acrylate, 30 parts by weight of hydroxyethyl acrylate, 3 parts by weight of acrylic acid and 3 parts by weight of acrylamide are copolymerized using the emulsion polymerization method thereby to obtain Copolymer A (which is an emulsion whose solid content is 45% by weight and has a glass transition temperature of about 17° C.).

(2) 50 parts by weight of styrene, 24 parts by weight of n-butyl acrylate, 10 parts by weight of hydroxyethyl acrylate, 10 parts by weight of hydroxyethyl methacrylate, 3 parts by weight of acrylic acid and 3 parts by weight of acrylamide are polymerized using the emulsion polymerization method thereby to obtain Copolymer B (which is an emulsion whose solid content is 45% by weight and has a glass transition temperature of about 28° C.).

(3) 44 parts by weight of acrylonitrile, 10 parts by weight of styrene, 30 parts by weight of n-butyl acrylate, 10 parts by weight of hydroxyethyl methacrylate, 3 parts by weight of acrylic acid and 3 parts by weight of acrylamide are polymerized using the emulsion polymerization method thereby to obtain Copolymer C (which is an emulsion whose solid content is 45% and has a glass transition temperature of about 34° C.). The above mentioned glass transition temperatures are values measured according to the penetration method.

As previously stated, the diazo photosensitive layer overlying the pre-coat layer contains, when the copying element of the present invention is of one-component type, a diazo compound (diazonium salt) but not a coupling component, and contains, when the copying element of the present invention is of binary type, both a diazo compound and a coupling component. As the diazo compound and the coupling component used in this photosensitive layer may be employed conventional ones. Some concrete examples of the diazo compound will be given hereinafter:

double salts of zinc chloride, cadmium chloride or tin chloride of chlorides of 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamimno-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-dimethylamino-3-carboxybenzene, 4-diazo-1-toluylmercapto-2,5-diethoxybenzene, 4-diazo-1,4-methoxybenzoylamino-2,5-diethoxybenzene and the like; sulfate, 4-hydrofluoborate and hexachlorophosphate of the above mentioned chlorides, and the like. However, it is needless to say that the diazo compound should not be limited to them.

And, some concrete examples of the coupling component (which forms an azo dye image in conjunction with the diazo compound) will be given hereinafter: resourcinol, phloroglucinol, 2,5-dimethyl-4-morpholinomethylphenol, 3-hydroxycyanoacetoanilide, parasulfoacetoanilide, 1-benzoylamino-8-hydroxynaphthalene-3,6-disulfonamide, 2,2-dihydroxynaphthalene, sodium 2,7-dihydroxynaphthalene-3,6-disulfonate, sodium 2,3-dihydroxy-6-sulfonate, sodium 2,5-dihydroxynaphthalene-6-sulfonate, sodium 1-hydroxynaphthalene-4-sulfonate, 1-amino-3-hydroxynaphthalene-3,6-disulfonamide, Naphthol AS, Naphthol AS-D, 2-hydroxynaphthalene-3-biguanide, 2-hydroxynaphthoic morpholinopropylamide, 2-hydroxynaphthoic ethanolamide, 2-hydroxynaphthoic acid-N-dimethylaminopropylamide hydrochloride, 2,4,2',4'-tetrahydroxydiphenyl, 2,4,2',4'-tetrahydroxydiphenyl sulfoxide and the like.

In the actual preparation of the diazo copying element, a pre-coat layer consisting essentially of fine particle silica and the above mentioned specific copolymer is first superimposed on a substrate. The weight ratio of the fine particle silica to the copolymer in this pre-coat is preferable to be in the range of about 1:0.5–5, and the quantity thereof adhered to the substrate (dry adhered quantity) is preferable to be in the range of 0.5–3 g/m$^2$.

In the pre-coat layer there may be used concurrently an organic or inorganic pigment such as fine particle starch, clay or the like, which has generally been used in the conventional diazo copying elements, as the image density promoter other than the fine particle silica, and further there may be used concurrently a proper quantity of lubricant such as polyethylene system wax, carnauba wax or the like, which has also been used in the conventional diazo copying elements, as the surface property improver.

The formation of this pre-coat layer is carried out in the manner of dispersing or dissolving said fine particle silica or the like and said specific copolymer in a suitable solvent (which has generally been used in this field) so as to prepare a fine particle-dispersed resin solution, coating said resin solution on the surface of the substrate by means of a wire bar, doctor blade or the like, and drying.

In succession, a one-component type or binary type diazo photosensitive layer (the quantity of solid adhered thereto is about 0.1–2.0 g/m$^2$) is formed on this pre-coat layer with a known means, thereby preparing a diazo copying element. In this instance, the suitable ratio of the diazo compound to the coupling component is a stoichiometrical one or so.

To this photosensitive layer there may be added sodium naphthalene-sulfonate, sodium naphthalene-disulfonate, sodium naphthalene-trisulfonate, sulfosalicylic acid, cadmium sulfate, aluminum sulfate, magnesium sulfate, cadmium chloride, zinc sulfide and the like for the purpose of improving the preservability of the element. And, there may be used thiourea, urea or the like as the antioxidant, caffeine, theophylline or the like as the solubilizer, and citric acid, tartaric acid, sulfuric acid, oxalic acid, boric acid, phosphoric acid, pyrophosphoric acid or the like as the antioxidant. Further, there may be added saponin as the coating ability improver and a small quantity of surface active agent. Still further, there may be added a binder such as polyvinyl alcohol, carboxymethyl cellulose or the like and a dye such as Methylene Blue, Methyl Violet, Patent Pure Blue or the like.

The thus prepared diazo copying element according to the present invention is of the one-component type or binary type. Accordingly, the formed image is made visible according to the dry developing process using ammonia gas, the wet developing process using an alkaline solution or a coupler-containing neutral or alkaline solution and the semi-dry developing process (the quantity of the developer coated on the diazo copying element is very small such as 5 g/m$^2$ or less) using an alkaline organic solvent or a coupler-containing neutral or alkaline organic solvent.

The copying element thus constructed according to the present invention is one which is capable of achieving the object intended by the present invention to the full.

EXAMPLES

All percentages used herein are by weight.

Example 1

A pre-coat layer of about 1.5 g/m$^2$ was formed on a white original paper for use in the diazo copying (55 g/m$^2$) by coating said original paper with a solution obtained by dispersing or dissolving a composition consisting of 50 g of fine particle silica (the mean particle diameter; about 1$\mu$) and 100 g of said Copolymer A (the solid content: 45%) in water so that the whole quantity amounted to 1 l, by means of a wire bar and drying. In succession, a photosensitive layer-forming solution of the under mentioned composition was prepared:

| | |
|---|---|
| Isopropyl alcohol | 50 ml |
| Citric acid | 20 g |
| Thiourea | 10 g |
| 2-hydroxy-3-naphthoic morpholinopropylamide | 15 g |
| 4-diazo-1-morpholino-2,5-dibutoxybenzene chloride.1/2$ZnCl_2$ | 10 g |
| Methylene Blue | 0.01 g |
| Cadmium chloride | 20 g |
| Saponin | 3 g |
| Boric acid | 10 g |
| Water (This was added so that the whole quantity amounted to 1 l) | |

The resulting solution was coated on the pre-coat layer by means of a wire bar and dried so as to form a photosensitive layer of about 1 g/m$^2$. A diazo copying element was thus prepared.

By using a commercially available dry type copying machine (RICOPY SM-1500 produced by RICOH COMPANY, LTD.), this diazo copying element was put together with a suitable original and exposed to light. Thereafter, the same was developed with ammonia gas to thereby obtain a blue image (Sample 1).

For comparison's sake, a copying element was prepared by the exactly same procedure except that an emulsion of polyvinyl acetate (the solid content: 45%) was employed in the pre-coat layer in place of Copolymer A (the solid content: 45%). This copying element was subjected to copying operation to thereby obtain a blue image (Sample 2).

In order to measure these samples in image fading, forced image fading tests were conducted in the manner of exposing these samples to radiation of light of 15,000 luxes for 3 hours and to radiation of sunlight for 8 hours by means of a fade-o-meter (produced by Suga Shikenki K.K.). The obtained results were as shown in Table-1. Sample 1 (obtained according to the present invention) was confirmed to be free from the image fading property (namely, to have an extremely improved image fading property). In this instance, the image density was measured by means of a photovoltaic densitometer (produced by Photovolt Company in U.S.A.).

TABLE 1

| | | Three hours' radiation using fade-o-meter | | Eight hours' radiation of sunlight | |
|---|---|---|---|---|---|
| | Image density before test | Image density after test | Image density difference between before and after test | Image density after test | Image density difference betwen before and after test |
| Sample 1 (according to our invention) | 1.25 (blue) | 1.11 (blue) | 0.14 | 1.15 (blue) | 0.10 |
| Sample 2 (control) | 1.25 (blue) | 0.83 (reddish purple) | 0.41 | 0.75 (reddish purple) | 0.45 |

Note
A bracketed color denotes the color tone of colored image.

EXAMPLE 2

A pre-coat layer of about 1.7 g/m$^2$ was formed on a white original paper for use in diazo copying (55 g/m$^2$) by coating said original paper with a solution obtained by dispersing or dissolving a composition consisting of 45 g of fine particle silica (the mean particle diameter: about 1$\mu$) and 80 g of said Copolymer B (the solid content: 45%) 20 g of polyethylene wax emulsion (the solid content: 50%) and 0.02 g of Methyl Violet in water so that the whole quantity amounted to 1 l, by means of a wire bar and drying. In succession, a photosensitive layer-forming solution having the under mentioned composition was prepared:

| | |
|---|---|
| Ethylene glycol | 40 ml |
| Tartaric acid | 20 g |
| Caffeine | 10 g |
| 2-hydroxy-3-naphthoic ethanolamide | 10 g |
| 4-diazo-1-morpholino-2,5-dipropoxybenzene chloride.1/2$ZnCl_2$ | 15 g |
| Zinc chloride | 20 g |
| Saponin | 1 g |
| Water (this was added so that the whole quantity amounted to 1 l) | |

The resulting solution was coated on the pre-coat layer by means of a wire bar and dried so as to form a photosensitive layer of about 1 g/m$^2$. A diazo copying element was thus prepared.

By using a commercially available semi-dry type copying machine (RICOPY SD-205 produced by RICOH COMPANY, LTD.), this diazo copying element was put together with a suitable original and exposed to light. Thereafter, the same was developed with an alkaline organic solvent (a mixed solvent consisting of 12 g of monoethanolamine, 30 g of glycerine, 50 g of ethylene glycol monomethylether and 8 g of water) to thereby obtain a blue image.

Further, this copy was subjected to the same forced image fading test using a fade-o-meter as in Example 1 to confirm that the image density difference between before and after the test was small such as 0.18, the color tone remained unchanged and the image fading property was very weak.

Example 3

By using a copying machine (RICOPY SD-205), the diazo copying element obtained in Example 1 was put together with a suitable original and exposed to light. Thereafter, the same was developed with an alkaline organic solvent (a mixed solvent consisting of 15 g of monoethanolamine, 30 g of ethylene glycol and 55 g of diethylene glycol monomethylether) to thereby obtain a blue image.

Further, this copy was subjected to the same forced image fading test as Example 1 to confirm that the image density difference between before and after the test was small such as 0.16, the color tone remained unchanged, and the image fading property was very weak.

Example 4

A pre-coat layer of about 1.2 g/m$^2$ was formed on a transparent resin finished paper (40 g/m$^2$) by coating said paper with a solution obtained by dispersing or dissolving a composition consisting of 65 g of fine particle silica (the mean particle diameter: about 1$\mu$), 20 g of fine particle starch (the particle diameter: about 3$\mu$), 140 g of the above mentioned Copolymer C (the solid content: 45%) and 1 g of Patent Pure Blue in water so that the whole quantity amounted to 1 l, by means of a wire bar and drying. In succession, a photosensitive layer-forming solution having the under mentioned composition was prepared:

| | |
|---|---|
| Methanol | 100 ml |
| Sulfosalicylic acid | 20 g |
| Aluminum sulfate | 10 g |

-continued

| | |
|---|---|
| 2-hydroxy-3-naphthoic dimethylaminopropylamide hydrochloride | 10 g |
| 3-hydroxycyanoacetoanilide | 2 g |
| 2,2', 4,4'-tetrahydroxydiphenylsulfide | 3 g |
| 4-diazo-morpholino-2,5-diethoxybenzene chloride.1/2$ZnCl_2$ | 20 g |
| Saponin | 1 g |
| Water (This was added so that the whole quantity amounted to 1 l) | |

The resulting solution was coated on the pre-coat layer by means of a wire bar and dried so as to form a photosensitive layer of about 0.8 g/m$^2$. A diazo copying element was thus prepared.

By using a copying machine (RICOPY SD-205), this diazo copying element was put together with a suitable original and exposed to light. Thereafter, the same was developed with an alkaline organic solvent (a mixed solvent consisting of 10 g of diethanolamine, 10 g of monoethanolamine, 5 g of potassium metaborate, 50 g of triethylene glycol monoethylether and 25 g of water) to thereby obtain a black image (Sample 3).

By using a copying machine (RICOPY SM-1500), on the other hand, this diazo copying element was put together with a suitable original and exposed to light. Thereafter, the same was developed with ammonia gas to thereby obtain a black image (Sample 4).

These samples were subjected to the same forced fading test using a fade-o-meter as in Example 1 to confirm that the image density difference between before and after the test was small such as 0.17 in Sample 3 and 0.14 in Sample 4, their color tone remained unchanged and both samples were extremely weak in respect of the image fading property. Further, the image areas of these samples were confirmed to be superior also in the antiultraviolet ray property and usable as the second original for diazo copying.

Comparative Example 1

50 parts by weight of acrylonitrile, 44 parts by weight of n-butyl acrylate, 3 parts by weight of acrylic acid and 3 parts by weight of acrylamide were copolymerized by the emulsion polymerization to thereby obtain Copolymer D (which was an emulsion whose solid content was 45% and had a glass transition of about 17° C.).

A control diazo copying element was prepared according to the exactly same procedure as Example 1 except that the above mentioned Copolymer D was employed in place of Copolymer A. This control element was observed to be inferior in the image fading property.

Further, this control element was subjected to the same forced fading test using a fade-o-meter as in Example 1 to find that the image density difference between before and after the test was 0.32.

Comparative Example 2

51 parts by weight of methyl methacrylate, 3 parts by weight of n-butyl acrylate, 3 parts by weight of acrylic acid and 3 parts by weight of acrylamide were copolymerized by the emulsion polymerization to thereby obtain Copolymer E (which was an emulsion whose solid content was 45% and had a glass transition temperature of about 17° C.).

A control diazo copying element was prepared according to the exactly same procedure as Example 1 except that the above mentioned Copolymer E was employed in place of Copolymer A. This control element was observed to be exceedingly inferior in the image fading property.

Further, this control element was subjected to the same forced fading test using a fade-o-meter as in Example 1 to find that the image density difference between before and after the test was 0.35.

Comparative Example 3

10 parts by weight of acrylonitrile, 54 parts by weight of n-butyl acrylate, 30 parts by weight of hydroxyethyl acrylate, 3 parts by weight of acrylic acid and 3 parts by weight of acrylamide were copolymerized by the emulsion polymerization to thereby obtain Colpolymer F (which was an emulsion whose solid content was 45% and had a glass transition temperature of about −33° C.).

A control diazo copying element was prepared according to the exactly same procedure as Example 1 except that the above mentioned Copolymer F was employed in place of Copolymer A. This control element was observed to have the image fading property in the range of from somewhat bad to bad.

Further, this control element was subjected to the same forced fading test using a fade-o-meter as in Example 1 to find that the image density difference between before and after the test was 0.28

We claim:

1. In a one-component or two-component diazotype copying element comprising a substrate, a precoat layer coating a surface of said substrate and a diazotype photosensitive layer coating said precoat layer, said diazotype photosensitive layer comprising a photosensitive diazonium compound capable of reacting with a coupler to form a developed visible color image on said diazotype photosensitive layer, the improvment which comprises: said precoat layer consists essentially of a blend of (A) finely divided silica particles, and (B) a copolymer having a glass transition temperature in the range of from −20° C. to 50° C., said copolymer having been prepared by emulsion polymerization of a mixture of monomers comprising (1) from 5 to 40% by weight of at least one first monomer selected from the group consisting of hydroxyalkylacrylates and hydroxyalkylmethacrylates, and (2) from 5 to 60% by weight of at least one second monomer selected from the group consisting of styrene and acrylonitrile, and said weight ratio of (A):(B) is 1:0.5–5.

2. A diazotype copying element as claimed in claim 1 in which the balance of said mixture of monomers consists essentially of (3) up to 90% by weight of at least one third monomer selected from the group consisting of methyl acrylate, methyl methacrylate, ethyl acrylate, ethyl methacrylate, propyl acrylate, propyl methacrylate, n-butyl acrylate, n-butyl methacrylate, i-butyl acrylate, i-butyl methacrylate, 2-ethylhexyll acrylate, 2-ethylhexyl methacrylate, α-methylstyrene, vinyl toluene, methacrylonitrile, vinyl acetate, acrylic acid, methacrylic acid, itaconic acid, maleic acid, glycidyl acrylate, glycidyl methacrylate, acrylamide, methacrylamide, N-methylolacrylamide and N-methylolmethacrylamide.

3. A diazotype copying element as claimed in claim 1 or claim 2 in which said first monomer is at least one monomer selected from the group consisting of hydroxyethylacrylate, hydroxyethylmethacrylate, hydroxypropylacrylate and hydroxypropylmethacrylate.

4. A diazotype copying element as claimed in claim 1 or claim 2 in which the amount of said precoat layer is from 0.5 to 3 $g/m^2$.

5. A diazotype copying element as claimed in claim 4 in which said finely divided silica particles have a particle diameter in the range of from about 0.1 to 10 microns.

6. A diazotype copying element as claimed in claim 5 in which the amount of said first monomer is from 10 to 30% by weight and the amount of said secnd monomer is from 20 to 50% by weight, both based the total weight of said monomers, and said copolymer has a glass transition temperature in the range of from 10° C. to 35° C.

7. A diazotype copying element as claimed in claim 1 in which said diazotype photosensitive layer is a two-component photosensitive layer also containing a coupling component capable of reacting with said diazonium compound under alkaline conditions to form a developed color image, and an acidic stabilizer.

8. A diazotype copying element as claimed in claim 6 in which said substrate is a paper sheet.

* * * * *